US009643698B1

(12) United States Patent
Andrasko et al.

(10) Patent No.: US 9,643,698 B1
(45) Date of Patent: May 9, 2017

(54) SYSTEMS AND METHODS FOR PROVIDING NOTIFICATION REGARDING TRIM ANGLE OF A MARINE PROPULSION DEVICE

(71) Applicant: Brunswick Corporation, Lake Forest, IL (US)

(72) Inventors: Steven J. Andrasko, Oshkosh, WI (US); Jason S. Arbuckle, Horicon, WI (US); Andrew J. Przybyl, Berlin, WI (US)

(73) Assignee: Brunswick Corporation, Lake Forest, IL (US)

( * ) Notice: Subject to any disclaimer, the term of this patent is extended or adjusted under 35 U.S.C. 154(b) by 196 days.

(21) Appl. No.: 14/573,200

(22) Filed: Dec. 17, 2014

(51) Int. Cl.
*B63H 21/22* (2006.01)
*B63B 45/04* (2006.01)

(52) U.S. Cl.
CPC ..... *B63B 45/04* (2013.01)

(58) Field of Classification Search
CPC ..... B63B 45/04
USPC ..... 340/984, 987
See application file for complete search history.

(56) References Cited

U.S. PATENT DOCUMENTS

| | | | |
|---|---|---|---|
| 3,777,694 | A | 12/1973 | Best |
| 3,999,502 | A | 12/1976 | Mayer |
| 4,050,359 | A | 9/1977 | Mayer |
| 4,318,699 | A | 3/1982 | Wenstadt et al. |
| 4,490,120 | A | 12/1984 | Hundertmark |
| 4,565,528 | A | 1/1986 | Nakase |
| 4,718,872 | A | 1/1988 | Olson et al. |
| 4,749,926 | A | 6/1988 | Ontolchik |
| 4,776,818 | A | 10/1988 | Cahoon et al. |
| 4,824,407 | A | 4/1989 | Torigai et al. |
| 4,836,810 | A | 6/1989 | Entringer |
| 4,861,292 | A | 8/1989 | Griffiths et al. |
| 4,872,857 | A | 10/1989 | Newman et al. |
| 4,898,563 | A | 2/1990 | Torigai et al. |
| 4,908,766 | A | 3/1990 | Takeuchi |

(Continued)

FOREIGN PATENT DOCUMENTS

| | | |
|---|---|---|
| EP | 2368791 B1 | 1/2013 |
| WO | 00/68744 | 11/2000 |

OTHER PUBLICATIONS

Mercury Marine, SmartCraft Manual, p. 21, 2013.

(Continued)

*Primary Examiner* — Brent Swarthout
(74) *Attorney, Agent, or Firm* — Andrus Intellectual Property Law, LLP

(57) ABSTRACT

A system for notifying an operator of a marine vessel that a marine propulsion device is not at an efficient trim angle includes a notification device and a controller that sends a signal to the notification device to provide a trim up notification when the controller determines that the marine propulsion device is not at the optimal trim angle. The controller determines this based on at least one of the following: a current load on an engine of the marine propulsion device; a current fuel flow provided to the engine; a current air flow provided via a throttle valve to the engine; or an output from a PID control section of the controller that controls a position of the throttle valve. A method that compares a measured engine speed to an optimal engine speed corresponding to operation of the marine propulsion device at an optimal trim angle is also provided.

18 Claims, 6 Drawing Sheets

(56) References Cited

U.S. PATENT DOCUMENTS 4,931,025 A 6/1990 Torigai et al.
4,939,660 A * 7/1990 Newman ..... F02D 41/1406 440/1
4,940,434 A 7/1990 Kiesling
4,957,457 A 9/1990 Probst et al.
5,080,064 A 1/1992 Buslepp et al.
5,113,780 A 5/1992 Bennett et al.
5,142,473 A 8/1992 Davis
5,171,172 A * 12/1992 Heaton et al. ..... 440/1
5,263,432 A 11/1993 Davis
5,352,137 A 10/1994 Iwai et al.
5,366,393 A 11/1994 Uenage et al.
5,385,110 A 1/1995 Bennett et al.
5,474,012 A 12/1995 Yamada et al.
5,474,013 A 12/1995 Wittmaier
5,507,672 A 4/1996 Imaeda
5,540,174 A 7/1996 Kishi et al.
5,647,780 A 7/1997 Hosoi
5,683,275 A 11/1997 Nanami
5,707,263 A 1/1998 Eick et al.
5,832,860 A 11/1998 Lexau
5,836,851 A 11/1998 Ruman
5,848,582 A 12/1998 Ehlers et al.
5,879,209 A 3/1999 Jones
6,007,391 A 12/1999 Eilert
6,009,371 A 12/1999 Kobayashi
6,095,077 A 8/2000 DeAgro
6,152,102 A 11/2000 Ruman
6,167,830 B1 1/2001 Pilger
6,273,771 B1 8/2001 Buckley et al.
6,298,824 B1 10/2001 Suhre
6,322,404 B1 11/2001 Magee et al.
6,354,237 B1 3/2002 Gaynor et al.
6,425,370 B1 7/2002 Kramer
6,458,003 B1 10/2002 Krueger
6,561,016 B1 5/2003 Suhre et al.
6,583,728 B1 6/2003 Staerzl
6,587,765 B1 7/2003 Graham et al.
6,701,890 B1 3/2004 Suhre et al.
6,733,350 B2 5/2004 Lida et al.
6,745,715 B1 6/2004 Shen et al.
6,757,606 B1 6/2004 Gonring
6,997,763 B2 2/2006 Kaji
7,143,363 B1 11/2006 Gaynor et al.
7,156,709 B1 1/2007 Staerzl et al.
7,163,000 B2 1/2007 Ishida et al.
7,188,581 B1 3/2007 Davis et al.
7,311,058 B1 12/2007 Brooks et al.
7,347,753 B1 3/2008 Caldwell et al.
7,357,120 B2 4/2008 Kaji
7,389,165 B2 6/2008 Kaji
7,416,456 B1 8/2008 Gonring et al.
7,462,082 B2 12/2008 Kishibata et al.
7,473,149 B2 1/2009 Mizokawa
7,530,865 B2 5/2009 Kado et al.
7,543,544 B2 6/2009 Yap
7,556,547 B2 7/2009 Kaji
7,617,026 B2 11/2009 Gee et al.
7,641,525 B2 1/2010 Morvillo
7,917,283 B2 3/2011 Kado
7,942,711 B1 5/2011 Swan
7,972,243 B2 7/2011 Kado et al.
7,976,354 B2 7/2011 Kubota et al.
8,011,982 B1 9/2011 Baier et al.
8,113,892 B1 2/2012 Gable et al.
8,145,370 B2 3/2012 Borrett
8,216,007 B2 7/2012 Moore
8,261,682 B1 9/2012 DeVito
8,340,847 B2 12/2012 Sako et al.
8,376,791 B2 2/2013 Chiecchi
8,376,793 B2 2/2013 Chiecchi
8,388,390 B2 3/2013 Kuriyagawa et al.
8,428,799 B2 4/2013 Cansiani et al.
8,444,446 B2 5/2013 Kuriyagawa et al.
8,457,820 B1 6/2013 Gonring
8,480,445 B2 7/2013 Morvillo
8,583,300 B2 11/2013 Oehlgrien et al.
8,622,777 B1 1/2014 McNalley et al.
8,631,753 B2 1/2014 Morvillo
8,740,658 B2 6/2014 Kuriyagawa
8,762,022 B1 6/2014 Arbuckle et al.
8,807,059 B1 8/2014 Samples et al.
8,855,890 B2 10/2014 Egle et al.
8,858,278 B2 10/2014 Morvillo
9,039,468 B1 5/2015 Arbuckle et al.
9,052,717 B1 6/2015 Walser et al.
9,145,839 B1 9/2015 Andrasko
9,156,536 B1 10/2015 Arbuckle et al.
9,248,898 B1 2/2016 Kirchhoff et al.
9,278,740 B1 3/2016 Andrasko et al.
9,290,252 B1 3/2016 Tuchscherer et al.
9,381,989 B1 7/2016 Poirier
2002/0086593 A1 7/2002 Shidara et al.
2003/0000500 A1 1/2003 Chatfield
2003/0013359 A1 1/2003 Suganuma et al.
2003/0027468 A1 2/2003 Into
2003/0054704 A1 3/2003 Kanno
2003/0109184 A1* 6/2003 Kanno ..... B63H 21/21 440/1
2003/0120360 A1 6/2003 Yasui et al.
2004/0069271 A1 4/2004 Kanno et al.
2004/0069272 A1 4/2004 Allen et al.
2005/0245147 A1 11/2005 Takada et al.
2006/0047406 A1 3/2006 Chatfield et al.
2006/0166573 A1 7/2006 Vetta et al.
2007/0089660 A1 4/2007 Bradley et al.
2008/0051979 A1 2/2008 Yasui et al.
2008/0280511 A1 11/2008 Kado
2010/0191397 A1 7/2010 Nose et al.
2011/0202258 A1 8/2011 Fukushima et al.
2011/0263167 A1 10/2011 Chiecchi et al.
2011/0297462 A1 12/2011 Grajkowski et al.
2012/0191275 A1 7/2012 Clever et al.
2013/0035009 A1* 2/2013 Kuriyagawa ..... B63H 21/21 440/1
2013/0312651 A1 11/2013 Gai
2013/0340667 A1 12/2013 Morvillo
2014/0209007 A1 7/2014 Morvillo
2014/0224166 A1 8/2014 Morvillo
2016/0068247 A1 3/2016 Morvillo

OTHER PUBLICATIONS

Mercury Marine, SmartCraft Manual, p. 2A-5, 2013.
U.S. Appl. No. 13/770,591, filed Feb. 19, 2013.
U.S. Appl. No. 14/177,767, filed Feb. 11, 2014.
Newport, Motion Control Coordinate System, www.newport.com, pp. 7-2 through 7-25, website visited Nov. 18, 2014.
U.S. Appl. No. 14/284,795, filed May 22, 2014.
Andrasko et al., "System and Method for Controlling Attitude of a Marine Vessel Having Trim Tabs", Unpublished U.S. Appl. No. 14/472,565, filed Aug. 29, 2014.
Andrasko et al., "Systems and Methods for Controlling Movement of Drive Units on a Marine Vessel", Unpublished U.S. Appl. No. 14/177,762, filed Feb. 11, 2014.

* cited by examiner

SYSTEMS AND METHODS FOR PROVIDING NOTIFICATION REGARDING TRIM ANGLE OF A MARINE PROPULSION DEVICE

FIELD

The present disclosure relates to marine propulsion systems, and more specifically to marine propulsion systems including marine propulsion devices that are able to be trimmed to a particular trim angle with respect to the marine vessel to which they are attached.

BACKGROUND

U.S. Pat. No. 4,872,857, hereby incorporated by reference herein, discloses systems for optimizing operation of a marine drive of the type whose position may be varied with respect to the boat by the operation of separate lift and trim/tilt means.

U.S. Pat. No. 7,416,456, hereby incorporated by reference herein, discloses an automatic trim control system that changes the trim angle of a marine propulsion device as a function of the speed of the marine vessel relative to the water in which it is operated.

U.S. Pat. No. 8,622,777, hereby incorporated by reference herein, discloses systems and methods for maneuvering a marine vessel that limit interference by the hull of the vessel with reverse thrust. A marine propulsion device provides at least a reverse thrust with respect to the marine vessel. The propulsion device is vertically pivotable into a trim position wherein the hull does not impede or interfere with the reverse thrust. A control circuit controls the propulsion device to move into the trim position when the reverse thrust of the propulsion device is requested.

U.S. application Ser. No. 14/177,767, filed Feb. 11, 2014, hereby incorporated by reference herein, discloses a method for positioning a drive unit on a marine vessel including receiving an initiation request from a user input device to operate the marine vessel in a desired operating mode and storing a first trim position of the drive unit in a memory upon receiving the initiation request. The method includes trimming the drive unit to a second trim position in response to the initiation request and subsequently operating the marine vessel in the desired operating mode with the drive unit in the second trim position. The method includes receiving a termination request to cancel the desired operating mode and trimming the drive unit to the first trim position automatically upon receiving the termination request. A system for positioning the drive unit is also disclosed.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

One example of the present disclosure is of a method for notifying an operator of a marine vessel that a marine propulsion device propelling the marine vessel is not at an efficient trim angle. The method includes determining a throttle valve position for a throttle valve on an engine of the marine propulsion device based on a helm input and moving the throttle valve to the throttle valve position. The method also includes measuring a speed of the engine after moving the throttle valve to the throttle valve position, and then comparing the measured engine speed to an optimal engine speed corresponding to operation of the marine propulsion device at an optimal trim angle with the throttle valve at the same throttle valve position. The operator is then provided with a notification that the marine propulsion device is not at an efficient trim angle if the measured engine speed is less than the optimal engine speed.

Another example of the present disclosure is of a system for notifying an operator of a marine vessel that a marine propulsion device propelling the marine vessel is not at an efficient trim angle. The system includes an operator notification device and a controller that sends a signal to the operator notification device to provide a trim up notification when the controller determines that the marine propulsion device is not at an optimal trim angle. The controller determines that the marine propulsion device is not at the optimal trim angle based on at least one of the following operating conditions: a current load on an engine of the marine propulsion device; a current fuel flow provided to the engine; a current air flow provided via a throttle valve to the engine; and an output from a PID control section of the controller that controls a position of the throttle valve.

BRIEF DESCRIPTION OF THE DRAWINGS

The present disclosure is described with reference to the following Figures. The same numbers are used throughout the Figures to reference like features and like components.

DETAILED DESCRIPTION

In the present description, certain terms have been used for brevity, clarity, and understanding. No unnecessary limitations are to be inferred therefrom beyond the requirement of the prior art because such terms are used for descriptive purposes only and are intended to be broadly construed.

Figure 1:
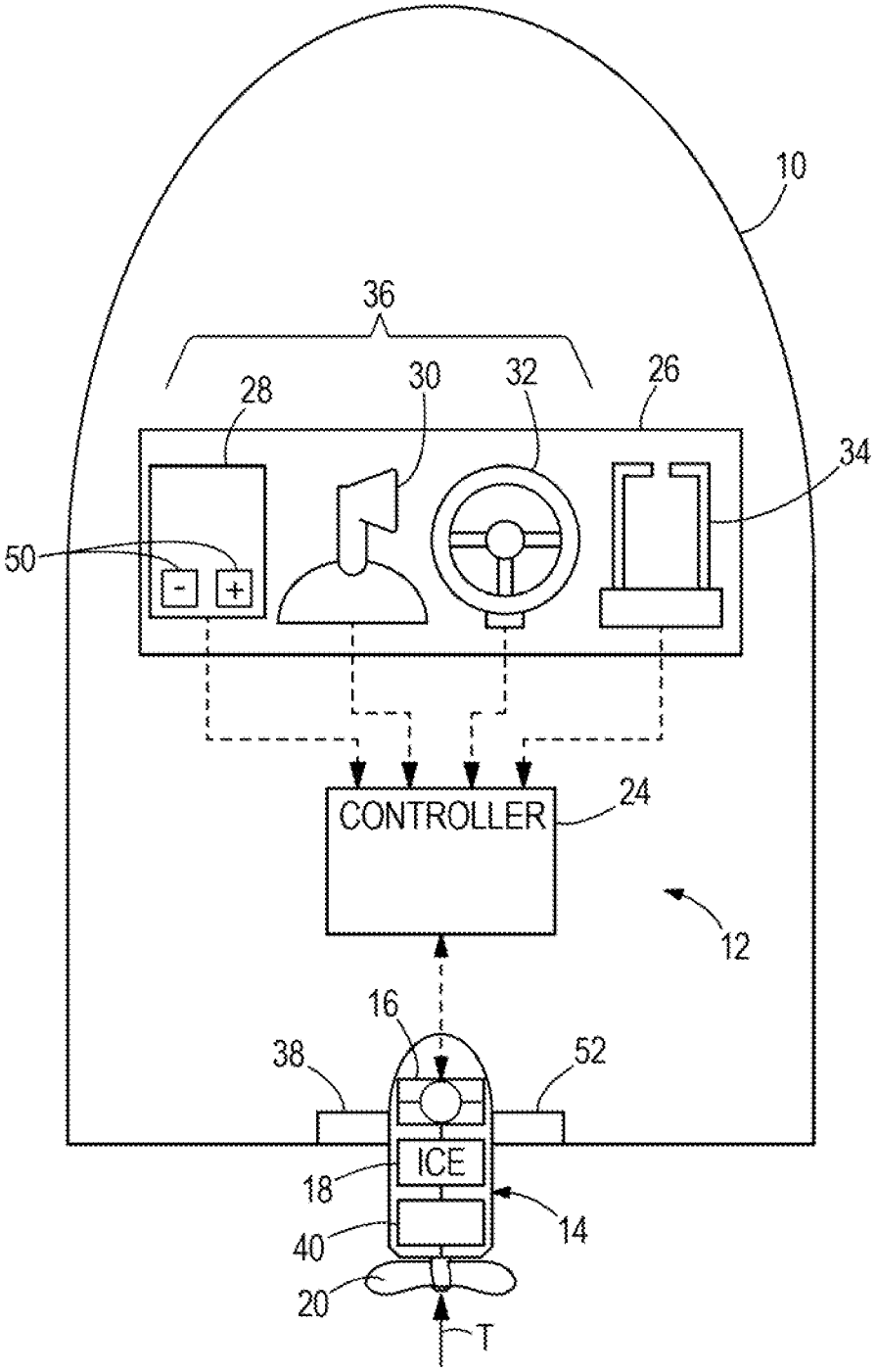
FIGS. 1-3 are used to illustrate several examples of marine propulsion systems on marine vessels according to the present disclosure.

FIG. 1 illustrates a marine vessel 10 having a marine propulsion system 12, including a marine propulsion device 14 coupled to the marine vessel 10. The marine propulsion device 14 is powered by an internal combustion engine 18. The internal combustion engine 18 is operatively connected in a torque-transmitting relationship with a propeller 20 by way of a transmission (not shown). Rotation of the propeller 20 by the internal combustion engine 18 produces a thrust T to propel the marine vessel 10. The amount of air entering an intake manifold of the internal combustion engine 18 is controlled by a throttle valve 16, which in one example is an electronic throttle valve in signal communication with a controller 24.

The controller 24 may include a memory and a programmable processor. As is conventional, the processor can be communicatively connected to a computer readable medium that includes volatile or nonvolatile memory upon which computer readable code is stored. The processor can access the computer readable code, and the computer readable medium upon executing the code carries out functions as described herein below. In other examples of the system 12, more than one controller is provided, rather than the single controller 24 as shown herein. For example, a separate controller could be provided in order to interpret signals sent from a helm 26 of the marine vessel 10, and a separate controller could be provided for the marine propulsion device 14. It should be noted that the dashed lines shown in FIG. 1 are meant to show only that the various control elements shown therein are capable of communicating with one another, and do not represent actual wiring connecting the control elements, nor do they represent the only paths of communication between the elements. The connections shown herein could be wired (for example via a serially wired CAN bus) or wireless.

The helm 26 includes a number of devices, such as an interactive gauge 28, a speaker 30, a light 32, and an input device 34, such as the throttle lever shown herein. The input device 34 could alternatively be a joystick, a touch screen, buttons, or other similar device. The controller 24 is in signal communication with each of the helm devices to accept commands from and/or provide signals to each device. For example, the controller 24 interprets inputs from the input device 34 and in turn communicates signals to the propulsion device 14, for example to provide commands regarding the position of the throttle valve 16 and/or a desired speed of the engine 18. Additionally, the helm 26 includes buttons 50 (for example provided on interactive gauge 28, although they may be provided elsewhere) that may be used to adjust the trim angle of the marine propulsion device 14. Actuation of the buttons 50 sends a signal to the controller 24, which thereafter sends a signal to a trim actuator 38 to trim the propulsion device 14 up to a trimmed-out position (see arrow 39, FIG. 2), back down to a neutral position (see FIG. 3), or even further down to a trimmed-in position (not shown). According to the present disclosure, any of the helm devices 28, 30, and 32 may serve as operator notification devices 36 for notifying an operator of the marine vessel 10 that the marine propulsion device 14 propelling the marine vessel 10 is not at an efficient trim angle, as will be described further herein below.

Marine vessel operators may choose to adjust the trim of the marine propulsion device 14 to the trimmed-in position while the marine vessel 10 is launching, in order to provide an optimal thrust angle for launch. Alternatively, the operator may choose to adjust the trim of the marine propulsion 14 device to the neutral position while the marine vessel is maneuvering at slower speeds. Alternatively, the operator may choose to trim the marine propulsion device 14 to the trimmed-up position while the marine vessel 10 is on plane and moving at higher speeds, which provides a somewhat downward thrust to maintain the bow of the marine vessel 10 in the water at such higher speeds. Often, the operator knows to trim the marine propulsion device up, down, or to a neutral position based on the operator's experience with operating the marine vessel 10. Sometimes, an operator will adjust the trim angle of the marine propulsion device 14 in order to provide optimal results in terms of vessel speed versus fuel consumption. Again, this adjustment by the operator is based on intuition, feel, and experience with operating marine vessels.

The present inventors have realized that in certain circumstances, such as for example when the engine 18 is being controlled to an operator-desired engine speed, it may be desirable to provide the operator with a notification that the marine propulsion device 14 is not at an optimal trim angle while the vessel 10 is on plane, and therefore the system 12 is not as fuel efficient as it otherwise could be (i.e. is not achieving top engine speeds that could otherwise be achieved for the same amount of fuel consumption). The present inventors have therefore developed a system that includes an operator notification device 36 and a controller 24 that sends a signal to the operator notification device 36 to provide a "trim up" notification when the controller 24 determines that the marine propulsion device 14 is not at an optimal trim angle. The controller 24 determines that the marine propulsion device 14 is not at the optimal trim angle based on at least one of the following operating conditions: a current load on the engine 18 of the marine propulsion device; a current fuel flow provided to the engine 18; a current air flow provided via the throttle valve 16 to the engine 18; or an output from a feedback control section 48 (see FIG. 3) of the controller 24 that controls a position of the throttle valve 16. These conditions will be described further herein below.

Figure 2:
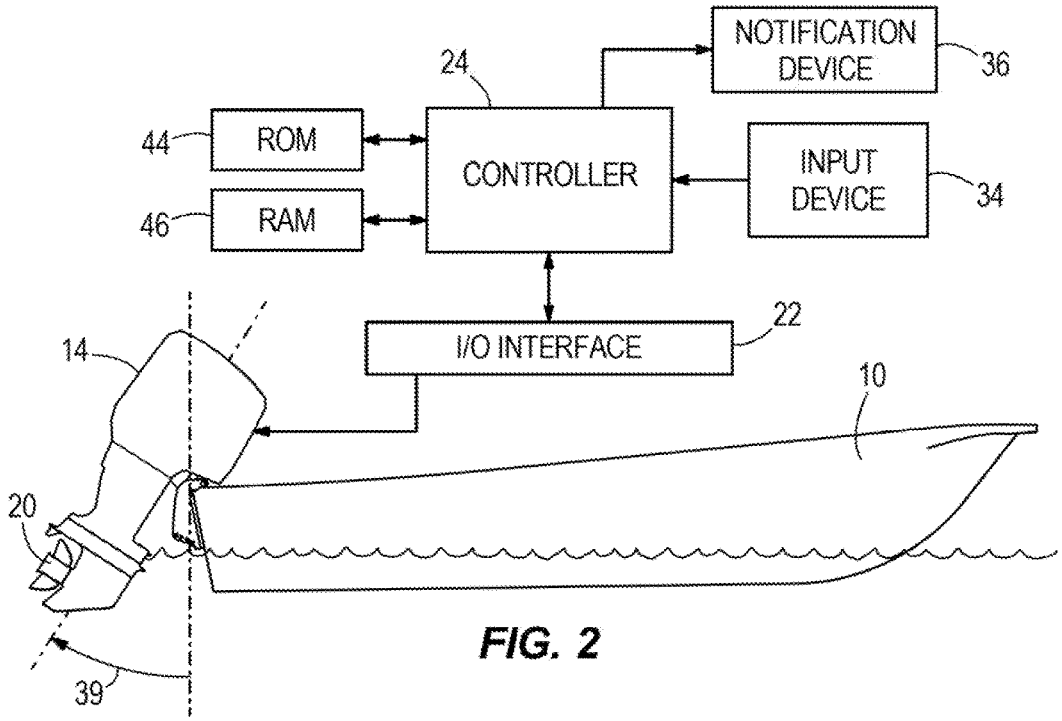

In order to describe the notification system of the present disclosure, two different methods for controlling operation of the engine 18 will first be described. In the system of FIG. 2, an input to the input device 34 represents a desired position of the throttle valve 16. In an example where the input device 34 is a throttle lever, the position of the throttle lever may be measured with a potentiometer, and a signal regarding the position of the throttle lever is sent to the controller 24. The controller 24 includes appropriate read only memory (ROM) 44, random access memory (RAM) 46, and a processor for interpreting the signal and converting it to a desired position of the throttle valve 16. The controller 24 sends this desired position through I/O interface 22 to the marine propulsion device 14, and more specifically to the an actuator, such as a motor, that actuates throttle valve 16 to the desired position. The speed of the engine 18 thereafter responds based on a load on the engine 18 and an amount of air provided to the engine's intake manifold via the throttle valve 16.

Figure 3:
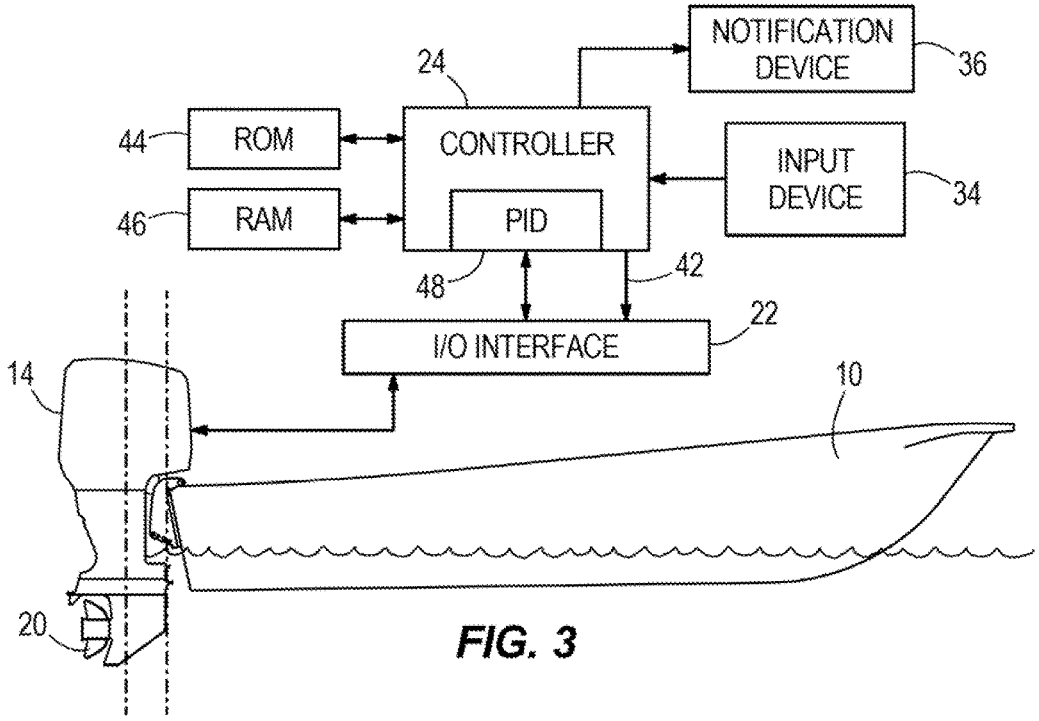

In contrast, FIG. 3 shows an example in which a helm input via the input device 34 represents an operator-selected engine speed. The controller 24 receives the engine speed command from the input device 34 and includes appropriate read only memory (ROM) 44, random access memory (RAM) 46, and a processor for interpreting the engine speed command and processing it: in response to the operator changing the operator-selected engine speed at input device 34 from a first-selected engine speed to a second-selected engine speed (engine speed setpoint), the controller 24 makes a prediction as to the position of the throttle valve 16 needed to provide the second-selected engine speed setpoint. The controller 24 then sends a feed forward signal at 42, which feed forward signal bypasses a proportional integral derivative (PID) feedback control section 48 of the controller 24 and is provided straight to input-output (I/O) interface 22, which in turn supplies a control signal to the marine propulsion device 14—more specifically to the actuator of throttle valve 16—to move the throttle valve 16 to the predicted throttle valve position. After movement of the throttle valve 16 to the predicted throttle valve position, the feedback control section 48 corrects the position of the throttle valve 16 as needed so as to obtain and maintain the engine speed at the second operator-selected engine speed.

The system of FIG. 3 is more fully described in U.S. Pat. No. 8,762,022, which is hereby incorporated by reference herein.

Therefore, in both the systems of FIGS. 2 and 3, the controller 24 determines a throttle valve position for the throttle valve 16 based on a helm input from input device 34, whether the throttle valve position be determined directly from a position of the input device 34, or by a feed forward signal and subsequent control with a feedback control section 48. The controller 24 then sends a signal via I/O interface 22 to an actuator to move the throttle valve 16 to the throttle valve position. A certain amount of air flow is associated with this throttle valve position, and can be determined from mass airflow calculations given information such as intake manifold pressure, intake manifold temperature, engine speed, barometric pressure, cylinder swept volume, number of combustion events per revolution, standard temperature, volumetric efficiency of the engine, and an air/fuel ratio of the fuel being used. These same values can be used to calculate fuel flow to the engine 18 as well. The controller 24 can thereafter determine whether the marine propulsion device 14 is at the optimal trim angle based on at least one of the following operating conditions: a current load on the engine 18 of the marine propulsion device; a current fuel flow provided to the engine 18; a current air flow provided via the throttle valve 16 to the engine 18; and an output from the feedback control section 48 of the controller 24 that controls a position of the throttle valve 16. The controller 24 thereafter compares a measurement of the at least one operating condition to a value of that same operating condition that was stored when the marine propulsion device 14 was operating at an optimal trim angle. If there is a discrepancy between the measurement and the stored value, the controller 24 sends a signal to the operator notification device 36 to provide a trim up notification.

In one example, the controller 24 determines whether the marine propulsion device 14 is at the optimal trim angle only when the marine vessel 10 is operating at steady state. This is because when the marine vessel 10 is on plane and at steady state, this is when the trim position of the marine propulsion device 14 has the most affect on fuel efficiency of the engine 18. In one example, the controller 24 will determine that the system 12 is operating under steady state conditions when the marine vessel 10 is above a minimum planning speed and has been at a stable speed and load for some predetermined period of time. If the operator initiates any kind of maneuver that changes the load on the engine 18, the system may go into standby. For example, if the operator makes a sharp turn that will cause a higher load on the engine 18, the controller 24 may disable the notification device 36 until steady state conditions are again met for a certain period of time.

In one example, the operator notification device 36 is a gauge 28 that displays a "trim up" indication to the operator. This trim up indication can be provided in many ways. For instance, the actual words "trim up" can appear on the screen of the gauge 28. The notification could alternatively be provided by a flashing arrow pointed in an upward direction appearing on the gauge 28. In another example, the operator notification device 36 is a light 32, such as a light next to a printed version of the words "trim up" on the dash at the helm. In another example, the operator notification device 36 is a speaker 30, and an automated voice speaks the words "trim up" when the controller 24 determines that the measured engine speed is less than the optimal engine speed for the given throttle valve position. Alternatively, the speaker 30 may emit a horn-like noise or a series of beeps. In other words, the type of operator notification device 36 and the type of notification that the device provides are not limiting on the scope of the present disclosure.

After the operator receives a notification to trim up, the operator may engage a trim input device, such as push buttons 50 located at the helm, for example on the interactive gauge 28, to follow the direction provided by the operator notification device 36. The operator notification device 36 will no longer provide the trim up notification after the operator has in fact trimmed up the marine propulsion device 14. For example, the controller 24 could determine that the operator has in fact trimmed up the marine propulsion device 14 by taking a reading from a trim sensor 52, such as a Hall Effect trim sender. Examples of Hall Effect trim senders that could be used are provided by Mercury Marine of Fond du Lac, Wis., part numbers 863187, 863187-1, 863187-A04, or 863187-A05. In one example, even after the operator has followed the trim up indication, the controller 24 makes a continual determination as to whether or not the marine propulsion device 14 is trimmed to the most efficient trim angle for the current operating conditions, and if it not, provides another trim up indication via the operator notification device 36.

Generally, after the operator has trimmed up the marine propulsion device 14, he will be able to determine whether any trimming down is required based on whether or not the marine vessel 10 begins to porpoise. However, the controller 24 may also be programmed to send a signal to the operator notification device 36 to provide a "trim down" notification when the measured engine speed, as determined by an engine speed sensor 40 (see FIG. 1), is less than a threshold that had been programmed into the memory of the controller 24. The engine speed sensor can be, for example, part number 864297 or 8M0011986 provided by Mercury Marine of Fond du Lac, Wis. This may provide a reminder to the operator that a preferred trim position of the marine propulsion device 14 when operating at a low engine speed is a neutral or trimmed down position. The trim down notification could be provided in similar way as the notifications described herein above regarding the trim up notification.

Figure 4:
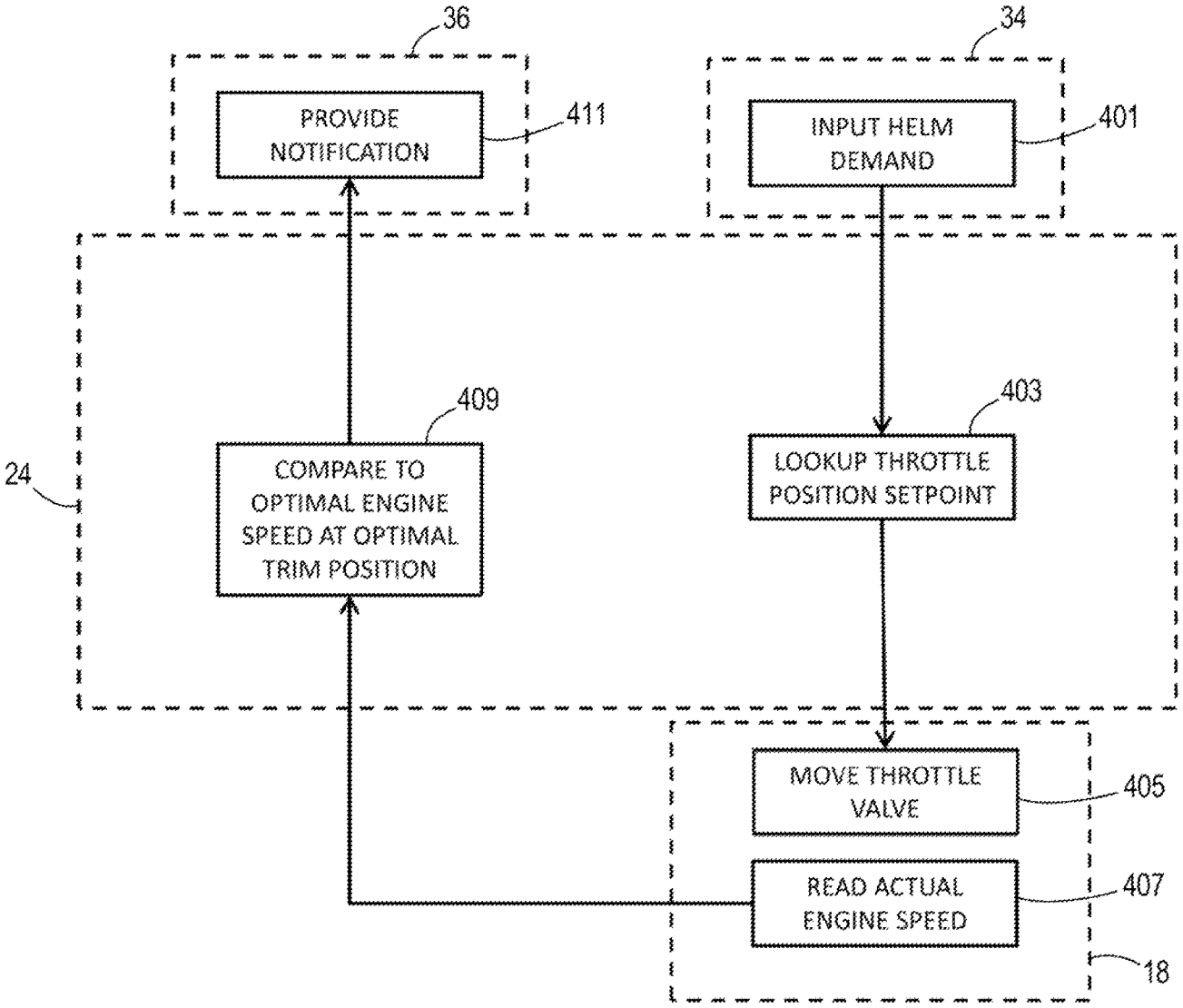
FIG. 4 illustrates a method for notifying an operator that a marine propulsion device is not at an efficient trim angle, which method is associated with the system of FIG. 2.

FIG. 4 is referred to in order to illustrate further details of a method associated with the system of FIG. 2. In general, according to this exemplary method, the engine speed sensor 40 (see FIG. 1) measures the speed of the engine 18 after the throttle valve 16 has been moved to the throttle valve position and sends the measured engine speed to the controller 24. The controller 24 compares the measured engine speed to an optimal engine speed corresponding to operation of the marine propulsion device 14 at an optimal trim angle with the throttle valve 16 at the same throttle valve position. The controller 24 will send a signal to the operator notification device 36 to provide a trim up notification when the measured engine speed is less than the optimal engine speed.

As shown at box 401, the operator inputs a demand via a helm input using input device 34. The helm input represents an operator-desired position of the throttle valve 16. Next, the helm input is used to look up the throttle position setpoint, as shown at box 403. Here, the helm input is converted from, for example, a signal from a potentiometer in the input device 34, to a position to which the throttle valve 16 is to be moved. For example, 0% helm demand (no movement of the input device 34) may correspond to the throttle valve being closed, while 100% helm demand (movement of the input device as far as it can go) may correspond to the throttle valve 16 being fully opened. Based on the throttle position setpoint, the controller 24 thereafter sends a signal to an actuator move the throttle valve 16, as shown at box 405. After movement of the throttle valve 16, the engine speed sensor 40 reads the actual engine speed as shown at box 407. This signal is sent back to the controller 24, which at box 409 compares the actual engine speed to an optimal engine speed were the engine 18 operating at an optimal trim angle at the same throttle valve position. Based on the result of the comparison at box 409, the controller 24 may send a signal to the operator notification device 36 to provide a notification when the marine propulsion device 14 is not at an efficient trim angle, as shown at box 411. In one example, the notification is a "trim up" notification.

Figure 5:
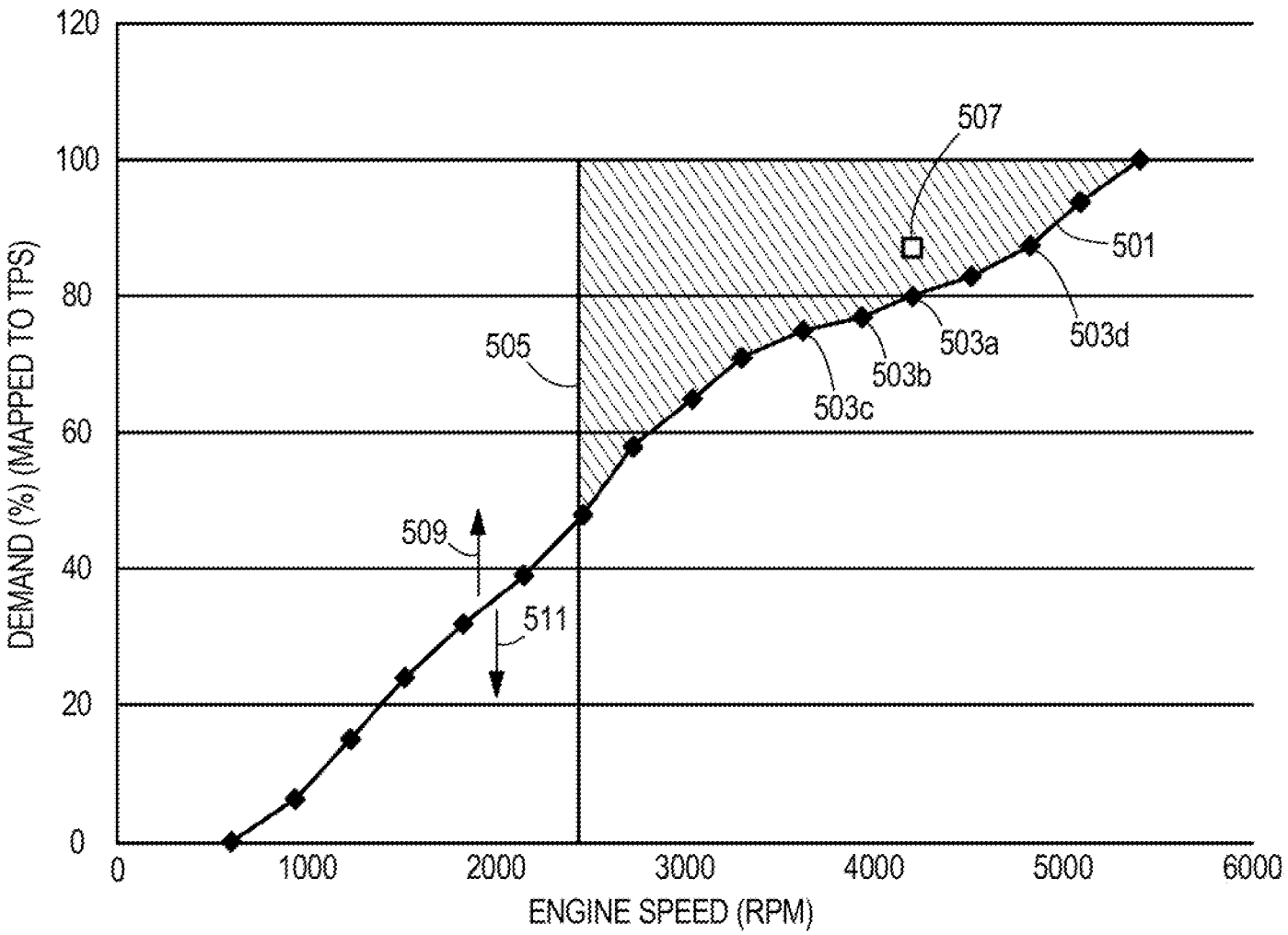
FIG. 5 illustrates one example of a curve that the system and method of FIGS. 2 and 4 can use to determine if a marine propulsion device is operating at an efficient trim angle.

To determine if the marine propulsion device 14 is trimmed to the optimal trim angle, the controller 24 may compare the measured engine speed at the current throttle valve position to a curve plotting optimal engine speeds at steady state against various throttle valve positions. An example of such a curve is shown in FIG. 5. FIG. 5 shows a plot of engine speed in RPM on the x-axis versus a demand in percent on the y-axis. As described herein above, the demand shown on the y-axis may be input via input device 34 at the helm 26 (see also box 401, FIG. 4) and may be mapped to a throttle position setpoint, as shown at box 403. The curve 501 shown in FIG. 5 is defined by a number of plotted points 503*a*, 503*b*, 503*c* etc. that have been taken from testing of a marine propulsion device 14 at many different helm demands. As the testing occurred, the operator trimmed the marine propulsion device 14 to the optimal trim angle based on the operator's intuition. The points therefore define a curve of optimal engine speeds at steady state against varying throttle valve positions. The line 505 represents an engine speed that would be needed to bring the marine vessel 10 on plane, and depends on the engine and the load on the marine vessel 10. As described herein above, in one example of the present system and method, the controller 24 only determines whether the measured engine speed is less than the optimal engine speed when the marine vessel is operating at steady state and on plane, i.e. its engine speed is above the minimum planing speed indicated at line 505.

If an actual engine speed corresponding to a particular demand input by the operator is higher than the minimum planing speed at line 505, and higher than the optimal curve 501, then this means that the measured engine speed is greater than the optimal engine speed that could be achieved at that same throttle position were the marine propulsion device 14 at an optimal trim angle. This less-than-optimal area is shaded in the plot shown in FIG. 5. As an example, if a current measured engine speed of about 4300 RPM and an actual demand/throttle position of about 85% map to point 507, then the trim angle is likely not optimized based on a comparison with the optimal curve 501 for this particular engine operating at an optimal trim angle. It can be seen from the plot that the optimal engine speed at the same throttle position setpoint of about 85% is about 5000 RPM (see point 503*d*), not the actual 4300 RPM at point 507. In this case, the controller 24 would send a signal to the operator notification device 36 to provide a trim up notification to the operator of the marine vessel 10.

It should be noted that the curve shown in FIG. 5 is only an example for one marine propulsion device 14 with a particular engine operating on a particular marine vessel 10 with a particular load, which curve 501 can be learned as the marine vessel 10 operates. The curve 501 can also be adapted up and down, as shown by the arrows 509 and 511, in order to learn optimal engine speeds at varying throttle positions when the load on the marine vessel 10 is different than when the test data shown in FIG. 5 was recorded. In other words, the curve 501 represents continuously adapting demand values corresponding to a minimum demand required to maintain a particular engine speed at steady state. In one example, the controller 24 is programmed with a deadband area on either side above and below the curve 501. If the current engine speed and throttle position map within this deadband, the controller 24 will not provide a notification to the operator of the marine vessel 10, which prevents the controller 24 from constantly telling the operator notification device 36 that the marine propulsion device 14 needs to be trimmed up, even after the trim conditions have been optimized.

Figure 6:
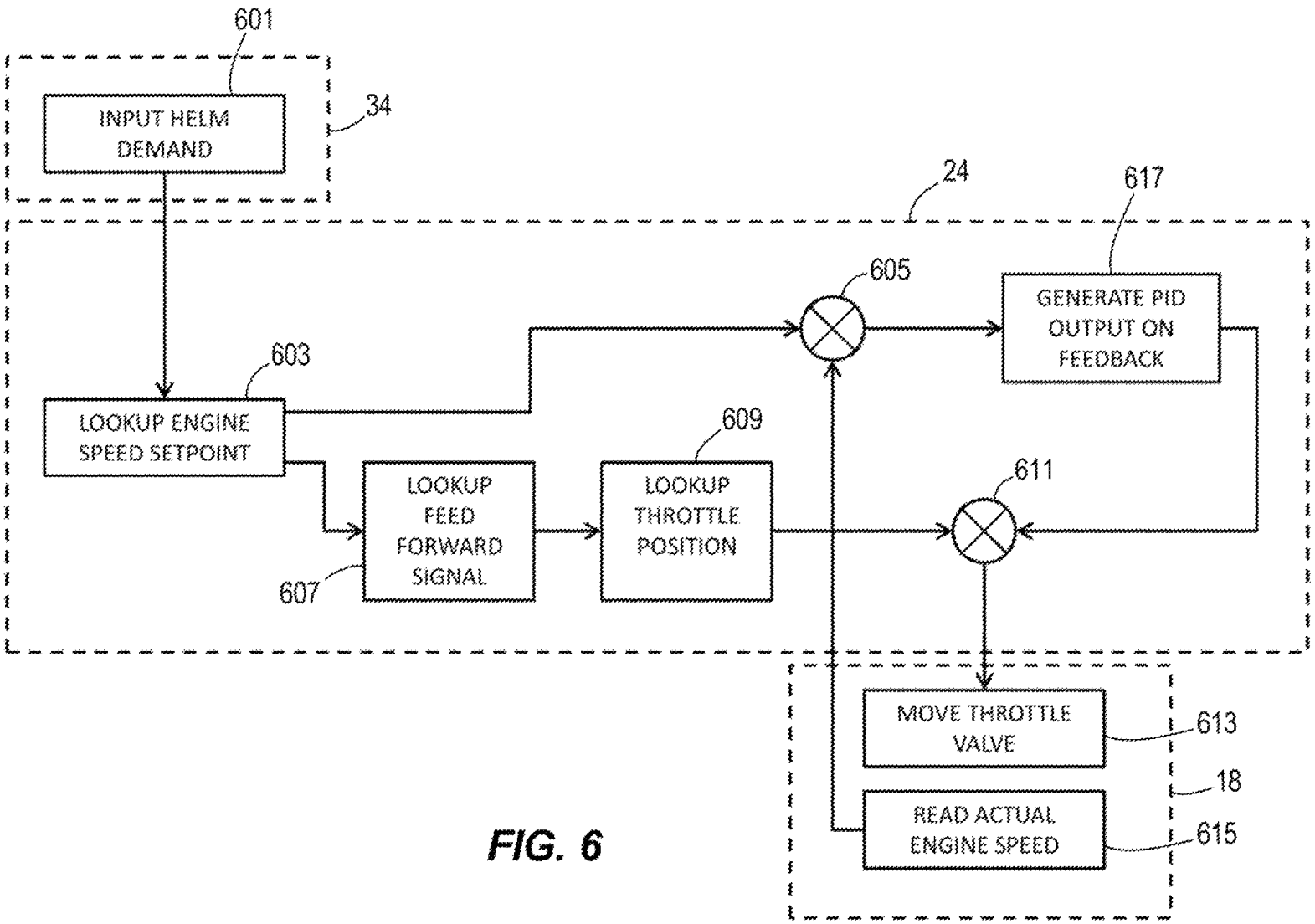
FIG. 6 illustrates a method for notifying an operator that a marine propulsion device is not at an efficient trim angle, which method is associated with the system of FIG. 3.

Now turning to FIG. 6, further details of a method associated with the system of FIG. 3 will be described. At box 601, the operator inputs a helm demand via input device 34. This helm demand is used to determine an engine speed setpoint, as shown at box 603, and the helm input therefore represents an operator-desired engine speed. The operator-desired engine speed is sent to a summer 605 and is also sent to box 607, to look up a feed forward signal. The feed forward signal is used to look up a throttle position, as shown at box 609. The throttle position signal is sent to summer 611, and thereafter passed along to the engine 18 to move the throttle valve 16, as shown at box 613. An engine speed sensor 40 reads the actual engine speed, as shown at box 615. The actual engine speed is sent to the summer 605, which compares the engine speed setpoint from box 603 with the actual engine speed from box 615 and sends this to a feedback control section 48 of the controller 24, which generates proportional, integral, and/or derivative (PID) output on the feedback, as shown at box 617. The controller 24 thereafter controls the throttle valve 16 with PID control over the difference between the measured engine speed and the operator-desired engine speed. For example, P-term and I-term gains, based on the actual engine speed and the engine speed setpoint, may be provided to the feedback control section 48. The feedback control section 48 can then determine a P-term and an I-term: the P-term gain is multiplied by the engine speed error to output a P-term, while the I-term gain is multiplied by the integral of the engine speed error to output an I-term. The P-term and the I-term are then added together and output from the feedback control section 48 to modify the signal that moves the throttle valve 16. In other examples, derivative control is included in the PID control.

In one example, the controller utilizes a PID control output to determine that the marine propulsion device 14 is not trimmed to the most efficient trim angle for a particular throttle valve position. For example, the controller 24 can use a P-term or an I-term from the PID output generated at box 617, or a combination of both, to determine whether the marine propulsion device 14 is at its most efficient trim angle. In one example, the I-term output from the feedback control section 48 may be adapted and used to change the feed forward signal provided at box 607 so as to drive the output of the PID control section at box 617 to zero. Such a method is described in Applicant's co-pending application Ser. No. 14/573,202, filed Dec. 17, 2014, which is hereby incorporated by reference herein. If the controller 24 determines that the amount of I-term adapt that is required at a particular engine speed is more than a required amount of I-term adapt a previous time the marine vessel 10 operated under the same conditions, the current trim angle may not be optimized. The controller 24 may therefore send a notification to the notification device 36 to trim up the marine propulsion device 14.

Figure 7:
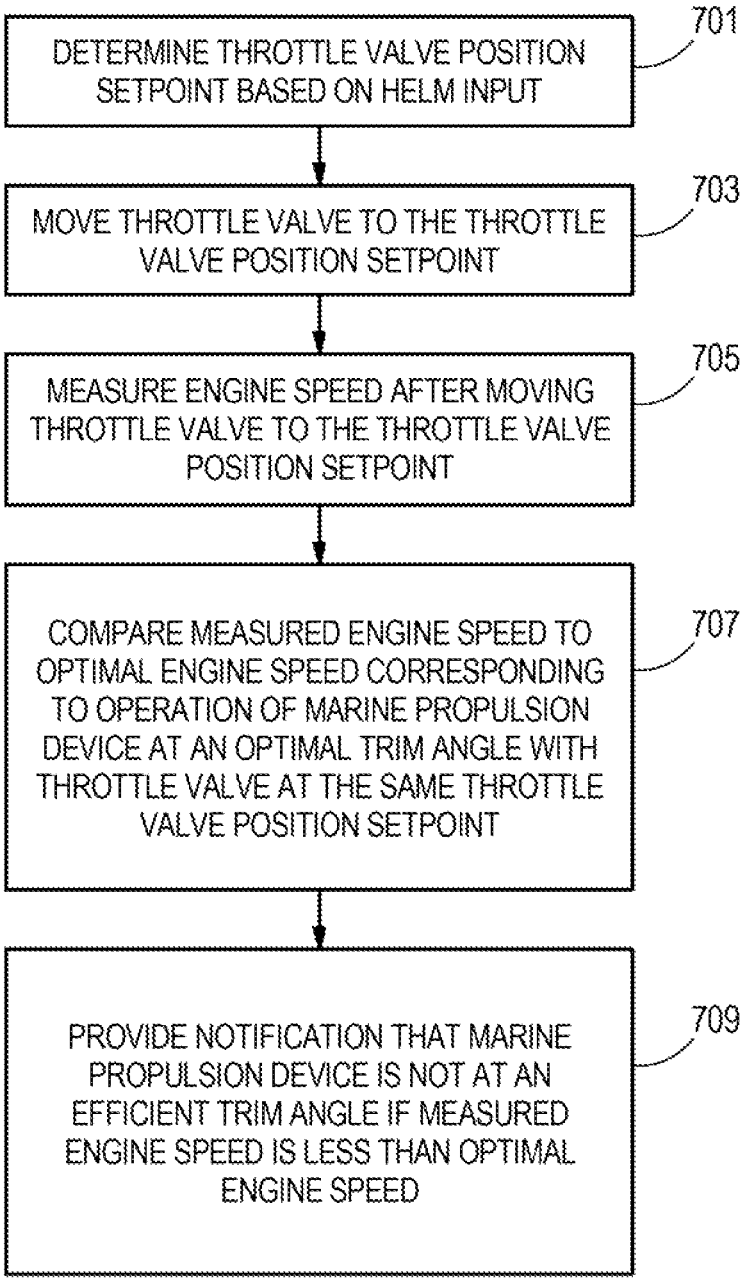
FIG. 7 illustrates another example of a method for notifying an operator that a marine propulsion device is not at an efficient trim angle.

Now turning to FIG. 7, a method for notifying an operator of a marine vessel 10 that a marine propulsion device 14 propelling the marine vessel 10 is not at an efficient trim angle will be described. As shown at box 701, the method includes determining a throttle valve position for a throttle valve on an engine of the marine propulsion device 14 based on a helm input. The method includes, as shown at box 703, moving the throttle valve to the throttle valve position. As shown at box 705, the method thereafter includes measuring a speed of the engine 18 after moving the throttle valve 16 to the throttle valve position. The method next includes, as shown at 707, comparing the measured engine speed to an optimal engine speed corresponding to operation of the marine propulsion device 14 at an optimal trim angel with the throttle valve 16 at the same throttle valve position. As shown at 709, the method then includes providing a notification that the marine propulsion device 14 is not at an efficient trim angle if the measured engine speed is less than the optimal engine speed.

In one example, the notification tells the operator that the marine propulsion device 14 needs to be trimmed up. The method may further comprise no longer providing the notification after the operator has trimmed up the marine propulsion device 14. In another example, the method further comprises providing a notification to the operator to trim down the marine propulsion device 14 when the measured engine speed is less than a threshold.

The method may further comprise comparing the measured engine speed to the optimal engine speed only when the marine vessel 10 is operating at steady state. The method may further comprise comparing the measured engine speed at the throttle valve position to a curve plotting optimal engine speed at steady state against throttle valve position.

In one example, the helm input represents an operator-desired engine speed, and the method further comprises controlling the throttle valve 16 with a feedback control section 48 of a controller 24 based on a difference between the measured engine speed and the operator-desired engine speed. The method may further comprise utilizing an output of the feedback control section 48 to determine that the measured engine speed is less than the optimal engine speed.

The method may further comprise, in other examples, automatically adjusting the trim angle of the marine propulsion device 14 to the optimal trim angle if the measured engine speed is less than the optimal engine speed. Such an auto-trim system may eliminate the need for the operator to trim the propulsion device 14 him/herself. The trim up notification may still be provided to the operator in such a case.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims.

What is claimed is:

1. A method for notifying an operator of a marine vessel that a marine propulsion device propelling the marine vessel is not at an efficient trim angle, the method comprising:

determining a throttle valve position for a throttle valve on an engine of the marine propulsion device based on a helm input;

moving the throttle valve to the throttle valve position;

measuring a speed of the engine after moving the throttle valve to the throttle valve position;

comparing the measured engine speed to an optimal engine speed corresponding to operation of the marine propulsion device at an optimal trim angle with the throttle valve at the same throttle valve position; and providing a notification that the marine propulsion device is not at an efficient trim angle if the measured engine speed is less than the optimal engine speed.

2. The method of claim 1, wherein the notification tells the operator that the marine propulsion device needs to be trimmed up.

3. The method of claim 2, further comprising no longer providing the notification after the operator has trimmed up the marine propulsion device.

4. The method of claim 2, further comprising providing a trim-down notification to the operator to trim down the marine propulsion device when the measured engine speed is less than a threshold.

5. The method of claim 2, further comprising comparing the measured engine speed to the optimal engine speed only when the marine vessel is operating at steady state.

6. The method of claim 5, further comprising comparing the measured engine speed at the throttle valve position to a curve plotting optimal engine speed at steady state against throttle valve position.

7. The method of claim 5, wherein the helm input represents an operator-desired engine speed, and further comprising controlling the throttle valve with a feedback controller based on a difference between the measured engine speed and the operator-desired engine speed.

8. The method of claim 7, further comprising utilizing an output of the feedback controller to determine that the measured engine speed is less than the optimal engine speed.

9. The method of claim 1, further comprising automatically adjusting a trim angle of the marine propulsion device to the optimal trim angle if the measured engine speed is less than the optimal engine speed.

10. The method of claim 1, further comprising providing the notification via a gauge located aboard the marine vessel.

11. A system for notifying an operator of a marine vessel that a marine propulsion device propelling the marine vessel is not at an efficient trim angle, the system comprising:

an operator notification device;

a controller that sends a signal to the operator notification device to provide a trim up notification when the controller determines that the marine propulsion device is not at an optimal trim angle;

an input device for providing a helm input to the controller, wherein the controller determines a position for a throttle valve on an engine of the marine propulsion device based on the helm input and sends a signal to move the throttle valve to the throttle valve position; and an engine speed sensor that measures a speed of the engine after the throttle valve has been moved to the throttle valve position and sends the measured engine speed to the controller;

wherein the controller compares the measured engine speed to an optimal engine speed corresponding to operation of the marine propulsion device at the optimal trim angle with the throttle valve at the same throttle valve position; and wherein the controller sends the signal to the operator notification device to provide the trim up notification in response to the measured engine speed being less than the optimal engine speed.

12. The system of claim 11, wherein the controller compares the measured engine speed to the optimal engine speed only when the marine vessel is operating at steady state.

13. The system of claim 12, wherein the controller compares the measured engine speed at the throttle valve position to a curve plotting optimal engine speed at steady state against throttle valve position.

14. The system of claim 11, wherein the controller sends a signal to the operator notification device to provide a trim down notification when the measured engine speed is less than a threshold.

15. The system of claim 11, wherein the operator notification device no longer provides the trim up notification after the operator has trimmed up the marine propulsion device.

16. The system of claim 11, wherein the controller sends a signal to a trim actuator of the marine propulsion device to automatically adjust a trim angle of the marine propulsion device to the optimal trim angle if the controller determines that the marine propulsion device is not at the optimal trim angle.

17. The system of claim 11, wherein the operator notification device is a gauge.

18. The system of claim 11, wherein the operator notification device is one of a light and a speaker.

* * * * *